US008147083B2

(12) United States Patent
Uke

(10) Patent No.: US 8,147,083 B2
(45) Date of Patent: Apr. 3, 2012

(54) HEADLIGHTS HAVING ADJUSTABLE INTENSITY

(75) Inventor: Alan K. Uke, Del Mar, CA (US)

(73) Assignee: Underwater Kinetics, Inc., Poway, CA (US)

( * ) Notice: Subject to any disclaimer, the term of this patent is extended or adjusted under 35 U.S.C. 154(b) by 54 days.

(21) Appl. No.: 11/972,841

(22) Filed: Jan. 11, 2008

(65) Prior Publication Data

US 2008/0285259 A1 Nov. 20, 2008

Related U.S. Application Data

(60) Provisional application No. 60/880,123, filed on Jan. 12, 2007.

(51) Int. Cl.
*F21L 4/04* (2006.01)

(52) U.S. Cl. ..... 362/105; 362/183; 362/249.02; 362/249.03; 362/249.07; 362/249.11

(58) Field of Classification Search ..... 362/105, 362/183, 103, 208, 249.02, 249.03, 249.07, 362/249.11, 285, 319
See application file for complete search history.

(56) References Cited

U.S. PATENT DOCUMENTS

| | | | | |
|---|---|---|---|---|
| 3,250,909 | A * | 5/1966 | Oldenburger | 362/205 |
| 3,798,668 | A * | 3/1974 | Hartmann | 396/62 |
| 4,533,984 | A | 8/1985 | Gatton | |
| 4,794,496 | A | 12/1988 | Lanes et al. | |
| 5,911,494 | A | 6/1999 | Lary | |
| D445,931 | S | 7/2001 | Shiu | |
| 6,848,804 | B2 | 2/2005 | Webber | |
| 6,905,223 | B2 | 6/2005 | Halasz | |
| 7,192,165 | B2 | 3/2007 | Petzl et al. | |
| 7,461,944 | B2 | 12/2008 | Alessio | |
| 2003/0067769 | A1 * | 4/2003 | Gilpin | 362/184 |
| 2003/0146706 | A1 | 8/2003 | Halasz | |
| 2005/0128737 | A1 | 6/2005 | Pare' | |
| 2005/0174782 | A1 * | 8/2005 | Chapman | 362/319 |
| 2005/0190550 | A1 | 9/2005 | Kennedy et al. | |

FOREIGN PATENT DOCUMENTS

| | | | |
|---|---|---|---|
| GB | 2404972 | A | 2/2005 |
| WO | WO 2006/133432 | A2 | 12/2006 |

* cited by examiner

*Primary Examiner* — Sharon Payne
(74) *Attorney, Agent, or Firm* — Acuity Law Group, P.C.; Daniel M. Chambers

(57) ABSTRACT

Headlights wherein one or more parameters associated with the illumination provided by the associated light source are described. Parameters that can be adjusted, for example, include the intensity of light exiting the headlight assembly, the dispersion of light emitted from the headlight, the direction of illumination, and the like.

15 Claims, 1 Drawing Sheet

HEADLIGHTS HAVING ADJUSTABLE INTENSITY

RELATED APPLICATION

This application claims the benefit of and priority to U.S. provisional application Ser. No. 60/880,123, filed on 12 Jan. 2007, the contents of which are herein incorporated by reference in their entirety for any and all purposes.

TECHNICAL FIELD

This invention concerns wearable headlights that are adjustable in terms of one or more parameters, including intensity, direction of illumination, and the like.

BACKGROUND OF THE INVENTION

1. Introduction

The following description includes information that may be useful in understanding the present invention. It is not an admission that any such information is prior art, or relevant, to the presently claimed inventions, or that any publication specifically or implicitly referenced is prior art.

2. Background

The present invention relates to the field of wearable headlight or headlamp devices wherein one or more parameters associated with the illumination provided by the lamp(s) of the headlight can be adjusted. Parameters that can be adjusted, for example, include the intensity of light exiting the headlight assembly, the dispersion of light emitted from the headlight, the direction of illumination, and the like.

3. Definitions

Before describing the instant invention in detail, several terms used in the context of the present invention will be defined. In addition to these terms, others are defined elsewhere in the specification, as necessary. Unless otherwise expressly defined herein, terms of art used in this specification will have their art-recognized meanings.

The term "electrically conductive material" or "electrical conductor" refers to any suitable material, or composite of different materials, that conducts electricity and can be adapted for use in the context of this invention. Examples of such materials include metals such as copper, brass, bronze, aluminum, a steel, and the like.

An "energy consumption unit" is a headlight of a device that consumes energy provided by the device's power supply to perform a desired or intended function. Representative examples of energy consumption units include light sources (or the light source assemblies that include one or more light sources) drives and motors, microprocessors, data storage devices (e.g., hard drives, flash memory chips, etc.), and the like.

With reference to the battery housing or body of a device according to the invention (e.g., a flashlight), the term "front end" refers to the end to which the bezel or head is attached, and "rear end" refers to the end opposite the bezel or head end.

Two or more components are in "heat conducting relation" when heat can be transferred from the hotter component to the cooler component. Preferably, a heat conductor provides for heat conduction between two or more device components.

A "heat conductive material" or "heat conductor" refers to any suitable material, or composite of different materials, that transfers heat by conduction, i.e., by molecular agitation within the material without movement of the material as a whole. Thus, a "heat conductor" is any component designed to conduct heat from one location in a device to another location in the device, for example, from and energy consumption unit to one or more batteries of the device's power supply. As is known, heat flows from hot to cold, such that if one end of a metal rod is at a higher temperature, then energy will be transferred down the rod toward the colder end because the higher speed particles in the hotter end will collide with the slower, cooler ones, transferring energy (i.e., heat) to the slower molecules, causing them to speed up. The rate of heat transfer is dependent on both the temperature gradient between the hot and cold components and the thermal conductivity of the material(s) used as the heat conductor. Metals tend to exhibit high thermal conductivity, as the mobile electrons used to in electrical conductance, participate in heat transfer. The following are representative metallic examples of heat conductors, ranked from highest to lowest thermal conductivity: silver, copper, gold, aluminum, brass, platinum, iron, steel, and lead. Non-metallic heat conductors include diamond. Heat conductors comprise heat conductive material(s), and are fashioned into the particular shape(s) required based on the particular application. Portions of a heat conductor may also be thermally insulated.

A "housing" refers to a structure (or combination of structures) that encloses one or more components, such as a light source, heat conductor, and power supply of a device according to the invention. A "battery housing" is a component of a battery-based power supply that houses the battery(ies). Such housings also typically include contacts or leads that allow the power supply to be connected to electrical circuitry in the device for which the power supply can provide energy. In some embodiments, other components, e.g., temperature sensors and the like, may also be included in a power supply.

A "light source" refers to a component that generates light when electrically energized, e.g., by an energy source such as one or more batteries. A light source includes one or more lamps that emit light, preferably light of one or more wavelengths in the range visible to humans. If desired, light in one or more non-visible wavelengths may also, or alternatively, be generated by a lamp, particularly when used in conjunction with a system that allows a user to visualize light of such otherwise non-visible wavelength(s). Here, "non-visible" light refers to light of a wavelength(s) outside the range of wavelengths visible to humans without assistance. Visible light typically refers to light of wavelengths within the range of about 400-700 nanometers. Lamps for light sources of the invention include, for example, light emitting diodes (LEDs), light bulbs, and the like.

A "light source assembly" refers to an assembly that includes a fitting for a light source or an integrated light source. In the context of the invention, such assemblies are usually configured to retain the light source within the device. Such an assembly can include components such as a socket or fitting for the light source(s), one or more light sources, a reflector to direct light out of the flashlight, one or more lenses to focus light emitted by the light source(s) and, if a reflector is included in the assembly, reflected by the reflector before passing through the lens(es), a filter and/or protective cover, and electrical contacts to electrically couple the light source to a power supply, or to electrical components that couple the power supply to the light source. In the context of LED-based light sources, a heat sink is also generally included as part of the assembly. In the context of this invention, it is understood that any such heat sink is distinct from the heat conductor and power supply of the device, although in preferred embodiments the heat sink of a light source assembly will be disposed in heat conducting relation with the heat conductor such that thermal energy present in the heat sink may traverse the heat conductor and flow to the power supply where at least some of it may be absorbed, for example, by the power supply's batteries.

The term "longitudinal axis" or "long axis" refers to a line that extends in perpendicular fashion between two parallel planes, one of which lies in a cross-section of the front end the housing and the other of which lies in a cross-section of the rear end of the housing.

A "parameter" refers to an observable property of something. For example, one "parameter" related to battery performance is battery life or half-life, or the time period (or 50% of the period) over which the battery delivers its rated energy output. In another example, a parameter associated with illumination from a light source includes light intensity, light dispersion, and direction of illumination.

A "patentable" composition, process, machine, or article of manufacture according to the invention means that the subject matter satisfies all statutory requirements for patentability at the time the analysis is performed. For example, with regard to novelty, non-obviousness, or the like, if later investigation reveals that one or more claims encompass one or more embodiments that would negate novelty, non-obviousness, or another requirement for patentability, the claim (s), being limited by definition to "patentable" embodiments, specifically exclude the unpatentable embodiment(s). Also, the claims appended hereto are to be interpreted both to provide the broadest reasonable scope, as well as to preserve their validity. Furthermore, if one or more of the statutory requirements for patentability are amended or if the standards change for assessing whether a particular statutory requirement for patentability is satisfied from the time this application is filed or issues as a patent to a time the validity of one or more of the appended claims is questioned, the claims are to be interpreted in a way that (1) preserves their validity and (2) provides the broadest reasonable interpretation under the circumstances.

In the context of a battery, a "primary" battery refers to a non-rechargeable battery, while a "secondary" battery refers to a rechargeable battery. In the context of a power supply, a "primary" power supply refers to the first, default, or primary energy source, whereas a "secondary" power supply refers a back-up power supply.

A "reflector" in a conventional light source assembly of a battery-powered flashlight refers to a component(s) for reflecting light from the light source(s) forward, or out of, the light source assembly and thus out of flashlight.

SUMMARY OF THE INVENTION

It is an object of this invention to provide wearable headlight devices wherein one or more parameters associated with the illumination provided by the headlight's light source can be adjusted, manually or automatically. Parameters that can be adjusted include, for example, the intensity of light exiting the headlight assembly, the dispersion of light emitted from the headlight, the direction of illumination, the color(s) (or wavelength(s)) of light being emitted from the device, and the like.

Such devices comprise a light cartridge inserted in a main body or housing. The main body has an opening through which light from a light source in the light cartridge can be emitted. At least one parameter of the light emitted from the light source, for example, intensity, dispersion or diffusion, focus, polarization, color, direction of illumination, and the like can be adjusted. Such adjustment can be performed manually or automatically, for example, by a motor and gears in response to a change in ambient light conditions, distance to a target object, condition of the power supply, and the like. In preferred embodiments, any of a plurality of different filters and/or lenses may be positioned proximate to the opening to adjust one or more parameter(s) associated with the illumination provided by the light source.

DETAILED DESCRIPTION

Figure 1A:
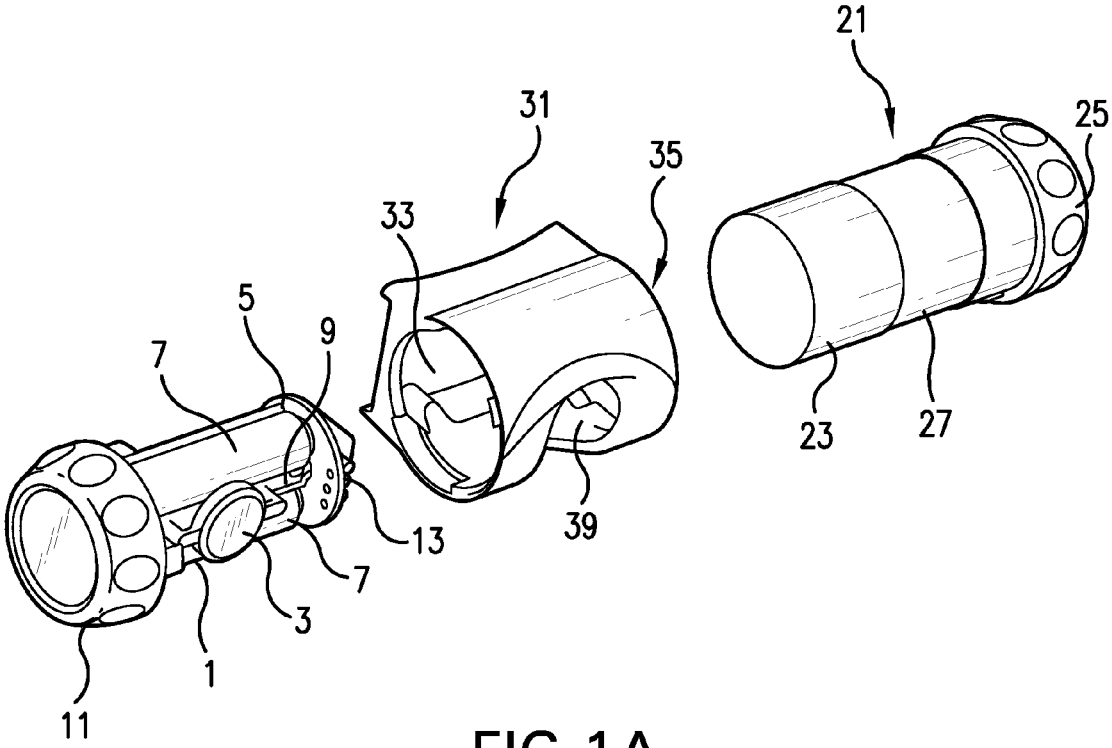
FIGS. 1A and 1B illustrate a preferred headlight according to the invention.

The present invention concerns electrically powered headlight devices (also sometimes referred to as "headlamps") that can be worn by users in order to provide adjustable illumination in low-light conditions. In general, such devices include a light cartridge inserted in a main body or housing. The light cartridge includes a light source, a power supply, and associated electrical circuitry to allow the light source to be energized by the power supply, preferably comprised of one or more batteries. Such circuitry preferably includes an on/off switch to allow the light source to be energized, and in some preferred embodiments can also include electronics to variably adjust or modulate the flow of energy between the light source and power supply.

A light cartridge comprises a light source, which includes one or more lamps or other light sources to generate light, in addition to the circuitry and/or electronics needed to provide functionality. Particularly preferred light sources are LEDs, especially those that produce white light. In some preferred embodiments, the light source comprises a plurality of lamps, some or all of which can be turned on together, either manually or automatically. In embodiments having light sources that comprise multiple, independently energized lamps, such redundancy can be used to conserve power, provide for modulated intensity or light volume as ambient light conditions change or when greater or lesser light may otherwise be desired by the user.

In many preferred embodiments, particularly those wherein the power supply comprises one or more batteries, the light cartridge also includes a heat conductive scaffold configured to hold the power supply's battery(ies) and transfer heat from the light source to the battery(ies). Such configurations are especially useful when a headlight device according to the invention is used in cold weather conditions, where transfer of waste heat from the light source to the power supply can enhance battery life and/or performance, thereby allowing the headlight to function under environmental conditions that could otherwise reduce or perhaps even preclude light generation by the device. Preferably, the heat conductive scaffold will be comprised of one or more heating conducting materials. Metals such as copper and aluminum, and alloys of such materials, are particularly preferred for producing heat conductive scaffolds.

As those in the art will appreciate, any power supply suited for producing or providing electrical energy to the light source can be adapted for use with the invention. While battery-based power supplies are preferred, other sources of electrical energy can also be employed, including fuel cells, generators, and the like. Factors influencing the power supply selected for a given application include, for example, the energy requirements of the light source employed; the conditions, or range of conditions in which the device is expected to be used; the overall size, weight, and design of the device; and the like. When rechargeable batteries are used, the headlight device can also include circuitry that allows a recharging electrical source to be connected to the device. In some of such embodiments, the rechargeable batteries may be removable; in others, the power supply may be designed to as not to be removable.

In preferred embodiments, a headlight's power supply is integrated within the light cartridge, particularly in those embodiments where heat is to be transferred between the light source and power supply. In some embodiments, however, particularly those wherein large power supplies are desired or required, the power supply may be located and packaged to be carried or worn elsewhere, for example, on a belt around the user's waist, in a clothing pocket, or in a backpack. In such embodiments, the power supply will be connected to the light cartridge by suitable cabling, which cabling may preferably be detached.

In preferred embodiments, light cartridges can be removed from the headlight's main body, especially when a battery-based power supply is integrated within the light cartridge. Such removal facilitates battery replacement or interchange. In those embodiments that provide water resistant or waterproof enclosures, the portions of the device that provide contact between the light cartridge and main body are adapted to provide the requisite closures. In some embodiments, one or more seals may be required. The capability to remove a light cartridge from the main body also makes possible the use of light cartridge as a freestanding lamp or flashlight.

In a device according to the invention, a light cartridge is disposed in the headlight body. In general, the main body is designed to include a cavity or other recess adapted to receive the light cartridge, preferably in manner that allows the light cartridge to be easily removed and reinserted into the cavity, for example, to facility change the changing of batteries, replacement of an inoperative lamp, and the like. In some embodiments, the cavity is also configured so as to allow some degree of rotation and/or lateral translation of the light assembly along or about the axis defined by the centerline of the cavity. In preferred embodiments, the cavity is essentially a substantially cylindrical bore in which a light cartridge having complementary cylindrical mating components can be inserted. See FIG. 1, for example. In some embodiments, the bore is open at only one end, whereas in other embodiments, the bore is open at both ends, for example, to receive a light cartridge in one opening and to receive an adjustable, rotatable lens at the other end.

The main body of a wearable headlight includes an aperture that aligns with the light source and through which light from the light source can be emitted. In preferred embodiments, the main body cavity and light cartridge are configured so as to allow the light cartridge to be inserted such that the light source will be positioned in or proximate to the aperture when properly inserted into the cavity.

The invention also envisions embodiments wherein the light cartridge includes a plurality of spaced lamps, or even a plurality of spaced light sources, any of which may or may not be independently energized in relation to the other lamp(s) or light source(s). In such embodiments, the main body may include a plurality of apertures, each designed to align with a particular lamp or light source.

In order to adjust one or more of the parameters associated with the illumination provided by the light source(s) of a headlight according to the invention, one or more filters and/or lenses is disposed proximate to the aperture by associating the filter(s) and/or lens(es) with the main body. Parameters that can be adjusted include light intensity, dispersion, or diffusion; focus; polarization; color; and/or direction of illumination. Light intensity can be adjusted many ways, including by using a filter to block transmission of some, most, or all of the light emitted from the associated light source. The degree of light blockage can range from less than about 1% to about 99% of incident light from the light source. Light intensity can also be adjusted by regulating current or voltage from the power supply, as well as by energizing differing numbers of lamps in light sources having more than one lamp. Combinations of such controls can also be used. Dispersion, diffusion, and focus can be adjusted using lenses or reflective materials. Transmission or emission of different colors (or wavelengths or ranges of wavelengths) can also be controlled in any suitable manner, including the use of filters, lamps that emit light within selected ranges of wavelengths, and the like. Particularly preferred colors to be transmitted post-filtration include white light, yellow light, green light, and red light. Polarization can be achieved by using a polarizing filter. Direction of illumination can be achieved by moving the headlight, or preferably, by moving the light source in relation to the main body, for example, by rotating the light carriage in relation to the main body.

In the context of the invention, filters or lenses can be moved or adjusted in relation to the light source(s), and can be disposed inside and/or outside the cavity for either or both manual or automated adjustment. Automatic adjustment can be provided to compensate for or address any number of factors, including changes in ambient light conditions, changes in distance to a target object, power supply condition, and the like. When automatic adjustment is desired, the device will also include a sensor and associated electronics and control logic to control the particular adjustment. Such sensors include light sensors for detecting or responding to changes in ambient light conditions, range finders for assessing distance to one or more targets, and sensors capable of monitoring the state of charge of the power supply, for example. Equipped with this specification, those in the art can readily generate any desired combination of sensing capability and automated control of the filter and/or lens system used in the context of a particular device embodiment.

Figure 1B:
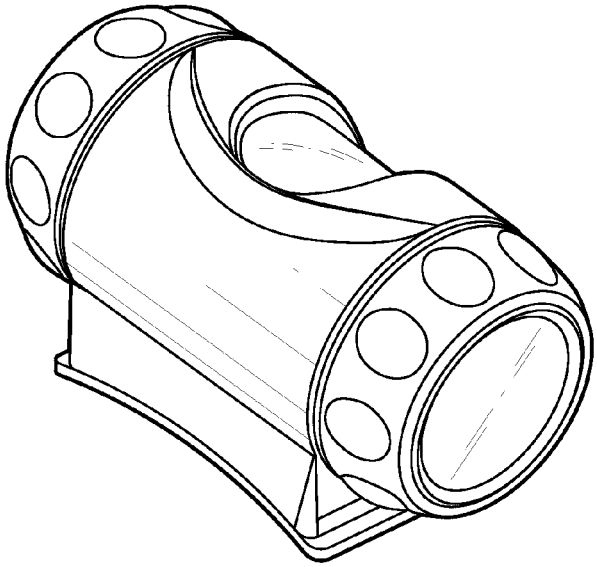

The particular lens or filter, or combination of lenses and/or filters, used in a particular device will depend on many factors, including the ultimate use to which the particular headlight device is intended to be put, the device's target price, the number and type of lamps and light sources, the power supply, the size and shape of the device, the illumination parameter(s) for which adjustment is to be provided, whether such adjustment is to be manual or/and or automatic, and the like. That said, a given lens or filter (or series of lenses and/or filters) will generally be positioned on the device such that light emitted from the light source(s) with which the filter(s) or lens(es) is(are) associated must travel through the filter(s) and/or lens(es). In certain preferred embodiments that employ a substantially cylindrical light source and main body, the lens may also be substantially cylindrical and be configured for insertion into an opening in the main body opposite the opening into which the light cartridge is inserted, as illustrated in FIG. 1, for example. In such embodiments, the lens or filter includes a lensing or filtering region, as the case be, that becomes proximately positioned above the lamp (s) of the associated light source in the area of the aperture in the main body. As will be appreciated, a filter or lens can be disposed on the outside of the lens body, within the cavity in which the light source is also disposed in the main body, or internally in the main body wall, provided that is can be moved in relation to the light source and aperture with which it is associated.

In addition to providing adjustment of at least one illumination parameter, a lens or filter can protect the underlying light source. Also, a filter or lens will have at least two distinct regions that can be positioned proximate to the aperture, typically by moving (such as by, for example, rotation) a substantially cylindrical filter or lens, although when two or more independently adjustable filters and/or lenses are used, one of them may have only one region. For example, in an embodiment having a single filter (see FIG. 1), one region may be a clear, transparent region and the other region may be a filtering or colored region. Transitions between different filtering or lensing regions on a given filter or lens can be abrupt, gradual, or graduated.

A filter or lens can be made from any suitable material, with optics quality plastics being preferred. Differences in filtering or lensing capability between different regions of the same filter or lens can result from a given filter or lens having filtering or lens regions that vary or differ, for example, in material, thickness, inclusion of material or films, and the like about their circumference.

The headlights of the invention also preferably include structures that allow a strap, headband, or the like to be attached to the headlamp so that the headlight can be worn on a user's head. Preferably, the strap or headband is adjustable to accommodate different users and to be comfortable when worn for extended periods. In addition, the strap or headband is preferably sufficiently flexible or stretchable so that it can be easily put on and taken off. When worn on a user's head, a headlight is typically positioned on the forehead such that it can be used to illuminate in front of the wearer. Of course, many headlight mounting system configurations and positions can be employed, with the final implementation of a particular embodiment being left to the designer. As those in the art will appreciate, a headlight according to the invention can also be attached or mounted to a hat, helmet, or other headgear using any suitable configuration of elements. Preferably, the headlight can be quickly removed from a wearer's head or headgear.

The headlight devices of the invention are preferably weather or water resistant, or even waterproof. As those in the art will understand, any suitable component configuration can be used to achieve such water resistance, although the particular configuration and types of seals and other components used ultimately depends upon the overall design of the particular embodiment.

The component parts of the devices of the invention can be made from any material, or combination of materials, that can be adapted for use in accordance with the invention. As those in the art will appreciate, however, materials such as plastics and metals are particularly preferred, as such materials are widely available, relatively inexpensive, durable, and can be easily molded or otherwise formed into suitable shapes.

DESCRIPTION OF A PREFERRED EMBODIMENT

FIG. 1 shows an exploded view of the primary components of a preferred embodiment of the invention. In this embodiment, the adjustable headlight comprises a light cartridge (1), a lens (21), and a main body (31). The light cartridge comprises a light source (3), a power supply (5) comprised of a plurality of batteries (7) disposed on a heat-conducting scaffold (9) on which the batteries and light source are supported and to which an adjustment knob (11) is connected at one end, and electronics (13) to energize the light source from the power supply. The light cartridge (1) can be inserted into a first opening (33) in the main body (31) to engage complementary structure to support and retain the light cartridge (1) within the main body such that the light source (3) can be positioned proximate to an aperture (39), preferably in a rotable, watertight fashion. For example, rotation of the light cartridge (1) in relation to the main body can be used to energize the light source, with light existing the device through the aperture (39). Alternatively, an on/off switch can be built into the device in any suitable location. Not shown in FIG. 1 is an adjustable, headstrap that can be inserted into the oppositely disposed slots shown in the base of the main body.

Opposite the first opening (33) in the main body is a second opening (35) into which a lens (21) can be inserted, preferably as a sleeve that covers the light source (3). The lens (21) includes a distal portion (23) opposite an adjustment wheel (25). Positioned between the distal portion and the adjustment wheel is a lens region (27) that covers the light source (3) when the lens (21) and light cartridge are assembled into the main body. Preferably, the distal portion (23) of the lens (21) seals watertightly against a seat in the light cartridge (1). When the lens (21) is rotated in relation to light source (3), different portions of the lens region (27) can be positioned over the light source (3). As a result, lenses having lens regions that vary or differ, for example, in material, thickness, inclusion of material or films, and the like about their circumference can be used to adjust a parameter of the illumination emitted from the headlight. Of course, additional filters may be positioned over the filter shown in FIG. 1.

Devices of the invention include many advantages and benefits as compared to conventional headlights. These include easily adjustable beam focusing and positioning, color adjustment, and for those devices that include heat transfer capability between the light sources and power supply, superior operation over a range of operating conditions.

The devices described herein can be made and executed without undue experimentation in light of the present description. While the devices of this invention have been described in terms of a preferred embodiment, it will be apparent to those of skill in the art that variations may be applied without departing from the spirit and scope of the invention. More specifically, it will be apparent that other power supplies, including those remote from the headlight, can be employed. In addition, those in the art will appreciate that devices according to the invention may include one or additional components to provide additional functionality. For example, sensors, motors, and drives can be associated with the headlight to provide automatic adjustment capability. All such adapted devices and modifications apparent to those skilled in the art are deemed to be within the spirit and scope of the invention.

The invention claimed is:

1. An adjustable, wearable headlight assembly, comprising:

a. a main body comprised of (i) a bore having a central axis and adapted to receive and retain a removable light cartridge and (ii) an aperture in a sidewall of the main body;

b. a removable light cartridge disposed in the bore of the main body and comprising a light source that includes at least one electrically powered lamp and circuitry for connecting the lamp(s) to a power supply, wherein when operably disposed in the main body the light source is positioned proximate to the aperture so as to allow light produced by the light source when energized to exit with a direction of illumination substantially perpendicular to the central axis of the main body's bore and pass through the aperture and out of the headlight assembly; and c. an adjustable lens associated with the main body's aperture and proximate to the light source, wherein the adjustable lens can be adjusted in relation to the aperture to adjust one or more parameters associated with light produced by the light source when energized.

2. An adjustable, wearable headlight assembly according to claim 1, wherein the removable light cartridge is rotable when operably disposed in the bore of the main body so as to allow the direction of illumination through the aperture to be adjusted.

3. An adjustable, wearable headlight assembly according to claim 1, wherein the lamp is an LED lamp.

4. An adjustable, wearable headlight assembly according to claim 3, wherein the light source comprises a plurality of LED lamps.

5. An adjustable, wearable headlight assembly according to claim 1, wherein the power supply comprises one or more batteries, wherein the batteries optionally are rechargeable.

6. An adjustable, wearable headlight assembly according to claim 1, wherein the position of the light source can be adjusted in relation to the main body.

7. An adjustable, wearable headlight assembly according to claim 1, wherein the light cartridge further comprises a power supply.

8. An adjustable, wearable headlight assembly according to claim 7, wherein the power supply is in heat conductive relation with the light source.

9. An adjustable, wearable headlight assembly according to claim 1, wherein the adjustable lens is adjusted manually.

10. An adjustable, wearable headlight assembly according to claim 1, wherein the adjustable lens is adjusted automatically.

11. An adjustable, wearable headlight assembly according to claim 1 further comprising a structure to secure the adjustable, wearable headlight assembly to a person's head, wherein the structure optionally is a headband or strap.

12. An adjustable, wearable headlight assembly according to claim 1 further comprising a structure to secure the adjustable, wearable headlight assembly to a person's head, wherein the structure optionally is a headband or strap.

13. An adjustable, wearable headlight assembly, comprising:

a. a main body comprised of (i) a substantially cylindrical bore having a central axis and adapted to receive and retain in rotable relation about the central axis a removable light cartridge and (ii) an aperture in a sidewall of the main body;

b. a removable light cartridge rotably disposed in the bore of the main body and comprising a light source that includes at least one electrically powered LED lamp and circuitry for connecting the lamp(s) to a power supply comprised of at least one battery, wherein when operably disposed in the main body the light source is positioned proximate to the aperture so as to allow light produced by the light source when energized to exit with a direction of illumination substantially perpendicular to the central axis of the main body's bore and pass through the aperture and out of the headlight assembly; and c. an adjustable lens associated with the main body's aperture and proximate to the light source, wherein the adjustable lens can be adjusted in relation to the aperture to adjust one or more parameters associated with light produced by the light source when energized.

14. An adjustable, wearable headlight assembly according to claim 13 wherein the removable light cartridge further comprises a heat conductive scaffold configured to hold one or more batteries in heat-conducting relation with the light source.

15. An adjustable, wearable headlight assembly according to claim 13 wherein the removable light cartridge further comprises a scaffold configured to hold a power supply comprised of at least one battery.

* * * * *